US007250905B2

(12) United States Patent
Judd

(10) Patent No.: US 7,250,905 B2
(45) Date of Patent: Jul. 31, 2007

(54) VIRTUAL ANTENNA TECHNOLOGY (VAT) AND APPLICATIONS

(76) Inventor: Mano Dorsey Judd, 316 Harbor Landing Dr., Rockwall, TX (US) 75032

( * ) Notice: Subject to any disclaimer, the term of this patent is extended or adjusted under 35 U.S.C. 154(b) by 136 days.

(21) Appl. No.: 10/821,112

(22) Filed: Apr. 8, 2004
(Under 37 CFR 1.47)

(65) Prior Publication Data

US 2005/0030228 A1 Feb. 10, 2005

Related U.S. Application Data

(60) Provisional application No. 60/461,505, filed on Apr. 9, 2003.

(51) Int. Cl.
*H01Q 3/00* (2006.01)

(52) U.S. Cl. ..... 342/377; 342/372

(58) Field of Classification Search ..... 342/368, 342/372, 373, 377

See application file for complete search history.

(56) References Cited

U.S. PATENT DOCUMENTS 3,599,216 A * 8/1971 Paine et al. ..... 343/771
5,818,385 A * 10/1998 Bartholomew ..... 342/372
6,058,105 A * 5/2000 Hochwald et al. ..... 370/310

* cited by examiner

*Primary Examiner*—Dao Phan

(57) ABSTRACT

Within an antenna array 120, the magnitude and phase of a relationship resulting from propagation delay between a sample taken at a first antenna 1 to a sample taken at a second antenna 2 at a different time is employed to derive a data value for a virtual antenna 3. Sub-patch antennas 203 perturbed in elevation are employed to expand the elevation range of acceptable gain. Multiple arrays each providing a separate radio frequency output are employed with digital beamform steering to a single point, together with low noise amplification at the feed point, to achieve sufficient gain with an acceptable total array size. A modular implementation with fiber transport is preferably used.

24 Claims, 7 Drawing Sheets

VIRTUAL ANTENNA TECHNOLOGY (VAT) AND APPLICATIONS

CLAIM FOR PRIORITY

This application claims priority to U.S. Provisional Patent Application Ser. No. 60/461,505 filed Apr. 9, 2003.

TECHNICAL FIELD OF THE INVENTION

The present invention is directed, in general, to antenna arrays and applications and, more specifically, to an antenna array including both physical and virtual antennas as well as applications for such an antenna array.

BACKGROUND OF THE INVENTION

Traditional antenna arrays exhibit performance related to the number of antenna elements. However, the complexity and cost of such arrays also increases rapidly as a function of the number of antenna elements. In addition, various limitations render current antenna array technology limited in application.

There is, therefore, a need in the art for improved antenna array technology, as well as improvements to various applications for antenna array technology.

SUMMARY OF THE INVENTION

To address the above-discussed deficiencies of the prior art, it is a primary object of the present invention to provide, for use in an antenna array system, derivation of the magnitude and phase of a relationship resulting from propagation delay between a sample taken at a first antenna to a sample taken at a second antenna at a different time to derive a data value for a virtual antenna. Sub-patch antennas perturbed in elevation are employed to expand the elevation range of acceptable gain. Multiple arrays each providing a separate radio frequency output are employed with digital beamform steering to a single point, together with low noise amplification at the feed point, to achieve sufficient gain with an acceptable total array size. A modular implementation with fiber transport is preferably used.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

Before undertaking the DETAILED DESCRIPTION OF THE INVENTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

FIGS. 1A through 4B, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged device.

Figure 1A:
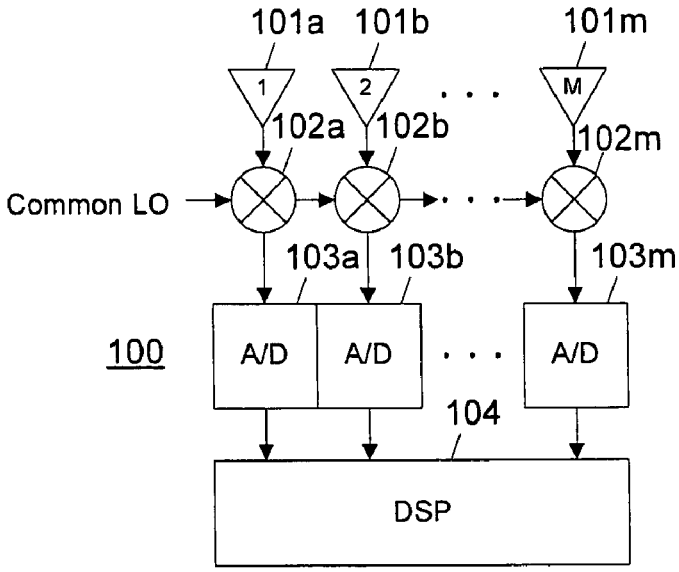
FIGURE 1A (Prior Art)
FIGS. 1A through 1F depict comparative diagrams of the structure and operation of a conventional antenna array and an antenna array with virtual antennas according to various embodiments of the present invention.

FIGS. 1A through 1F depict comparative diagrams of the structure and operation of a conventional antenna array and an antenna array with virtual antennas according to various embodiments of the present invention. FIG. 1A depicts a traditional "digital" linear antenna array system. Antenna array system 100 includes a plurality of M linearly-aligned antennas 101*a*–101*m* (where "M" and "m" are equal to each other and both equal to any positive integer greater than one). Each antenna 101*a*–101*m* receives a signal which is mixed with a common local oscillator (LO) signal at mixers 102*a*–102*m*. The outputs of mixers 102*a*–102*m* are passed through analog-to-digital (A/D) converters 103*a*–103*m*. A digital signal processor (DSP) 104 received signals from A/D converters 103*a*–103*m*.

Within antenna array system 100, a beamformed array gain G is achieved based on the number M of antenna elements:

$$G \sim 10 \log_{10}(M). \quad (1)$$

The half-power beam width (HPBW) resolution is given by:

$$\text{HPBW} \sim \frac{57^\circ}{M-1} \tag{2}$$

for sensors (antennas 101$a$–101$m$) spaced ½λ, where λ is the wavelength of the desired or subject signal, giving an array size (including the ground plane) of ½λ·M. The array system 100 has M (theoretical) degrees of freedom, such that M−1 is the maximum number of interers or jamming devices that may be handled by system 100.

Figure 1B:
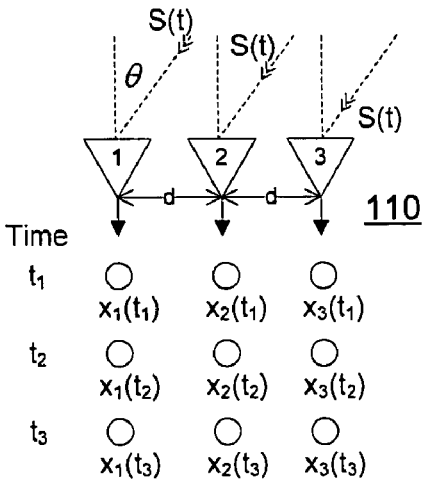
FIGURE 1B (Prior Art)

FIG. 1B illustrates operation for one embodiment of the traditional linear array antenna system. Antenna system 110 has three linearly-aligned antennas spaced apart by a distance d. For an incident plane wave S(t) arriving at an angle θ with respect to an antenna reference direction, the baseband complex digital samples received at antennas 1–3 at times $t_1$, $t_2$ and $t_3$ may be represented as: $x_1(t_1)$, $x_2(t_1)$, and $x_3(t_1)$; $x_1(t_2)$, $x_2(t_2)$, and $x_3(t_2)$; and $x_1(t_3)$, $x_2(t_3)$, and $x_3(t_3)$. The delay between portions of plane wave S(t) arriving at different antennas is given by:

$$\text{delay} = \frac{d \cdot \sin\theta}{c} \tag{3}$$

where c is the velocity of wave propagation. The digital sample data may therefore be expressed as:

$$x_1(t_1)=S(t_1)e^{-j\cdot\omega\cdot delay\cdot 2}+n_1(t_1)$$

$$x_2(t_1)=S(t_1)e^{-j\cdot\omega\cdot delay\cdot 1}+n_2(t_1),$$

$$x_3(t_1)=S(t_1)e^{-j\cdot\omega(0)}+n_3(t_1)$$

$$x_1(t_2)=S(t_2)e^{-j\cdot\omega\cdot delay\cdot 2}+n_1(t_2)$$

$$x_2(t_2)=S(t_2)e^{-j\cdot\omega\cdot delay\cdot 1}+n_2(t_2)$$

$$x_3(t_2)=S(t_2)e^{-j\cdot\omega(0)}+n_3(t_2)$$

and $$x_1(t_3)=S(t_3)e^{-j\cdot\omega\cdot delay\cdot 2}+n_1(t_3)$$

$$x_2(t_3)=S(t_3)e^{-j\cdot\omega\cdot delay\cdot 1}+n_2(t_3).$$

$$x_3(t_3)=S(t_3)e^{-j\cdot\omega(0)}+n_3(t_3)$$

Figure 1C:
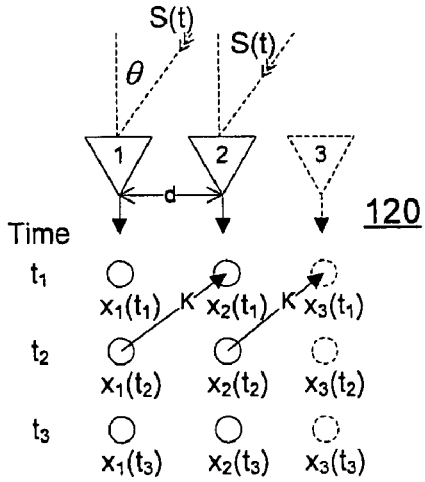

FIG. 1C illustrates operation of an antenna array including virtual sensors according to one embodiment of the present invention. Antenna system 120 includes only two antennas 1–2, with a third "virtual" antenna 3. By letting $$x_1(t_2)\cdot K = x_2(t_1) \Rightarrow K = \frac{x_2(t_1)}{x_1(t_2)}, \tag{4}$$

a virtual sensor (antenna) $x_3'$ may be created by blind mapping $$K\cdot x_2(t_2)=x_3'(t_1) \tag{5}$$

such that, for the noiseless case:

$$x_3'(t_1) = \frac{x_2(t_1)}{x_1(t_2)} \cdot x_2(t_2). \tag{6}$$

The expression for $x_3'(t_1)$ may alternatively be written as:

$$\begin{aligned} x_3'(t_1) &= \left[\frac{S(t_1)e^{-j\cdot\omega\cdot delay\cdot 1}}{S(t_2)e^{-j\cdot\omega\cdot delay\cdot 2}}\right]S(t_2)e^{-j\cdot\omega\cdot delay\cdot 1} \\ &= \left[\frac{S(t_1)\cdot S(t_2)}{S(t_2)}\right]\cdot\frac{e^{-j\cdot\omega\cdot[delay\cdot 1+delay\cdot 2]}}{e^{-j\cdot\omega\cdot delay\cdot 2}} \\ &= S(t_1)\cdot e^{-j\cdot\omega(0)}, \end{aligned} \tag{7}$$

which produces the actual signal value and correct phase for $x_3'(t_1)$.

For the noisy case, the solution is more complex but ultimately arrives at:

$$x_3'(t_1)=S(t_1)\cdot e^{-j\cdot\omega(0)}+\text{noise}_{13}\text{ term}. \tag{8}$$

Figure 1D:
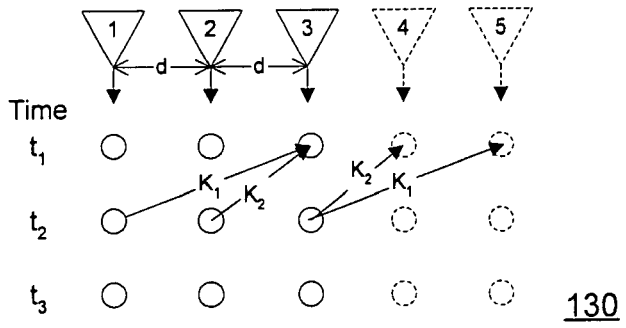
Figure 1E:
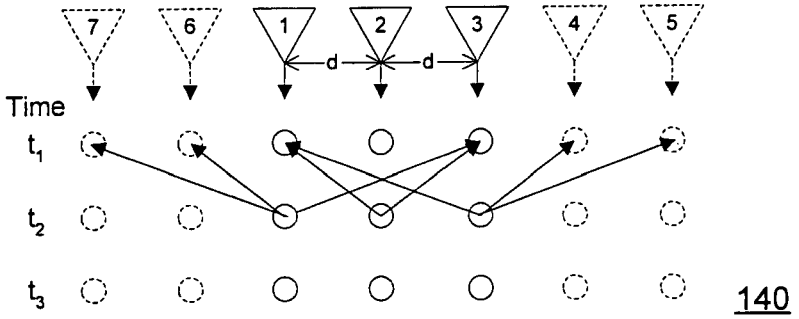

FIG. 1D illustrates expansion of the antenna array to include a system 130 having physical antennas 1-3 and more than one virtual sensor 4–5. In this embodiment, two multiplier terms $K_1$ and $K_2$ are derived for use in generating data values for the virtual sensors. FIG. 1E illustrates that the extension of the principle to either side of a physical antenna array, to further increase the number of virtual sensors within an antenna system 140.

An antenna array having an original aperture of M physical antennas and including P virtual sensors according to the present invention will exhibit a beamformed array gain G of:

$$G \sim 10\log_{10}[M+P\cdot(M-1)] \tag{9}$$

as well as a highly improved resolution:

$$\text{HPBW} \sim \frac{57^\circ}{M+P\circ(M-1)}. \tag{10}$$

The number of degrees of freedom is also increased, even though the physical array size is conserved or optionally reduced.

A number of application may exploit the use of virtual sensors according to the present invention, including: radio frequency (RF) and acoustic sensing and/or direction finding (DF); digital radar; radio stellar cartography; as anti-jamming for global positioning system (GPS) systems; sonar line-of-bearing (LOB) systems; digital beamforming in commercial services such as cellular or Third Generation (3G) wireless communications, or real time data networks; or as a broadcast receiver for satellite or terrestrial digital broadcast systems (DBS), such as found in mobile vehicles, where smaller, more aesthetic antenna systems having no moving parts may be employed with self-tracking and alignment to satellites. Use of the present invention may improve the critical time on target parameter for existing systems.

Use of virtual antennas as described above differs from synthetic aperture radar (SAR) and synthetic aperture sonar (SAS) in that no movement of the array is required. Instead, a coherent virtual sensor is achieved by "blind" mapping. In addition, the virtual antenna technology may be employed on real time signals. For these reasons, the present invention may also be employed to improve imaging systems such as SAR and SAS, and those employed in unmanned aerial vehicles (UAVs) employed for airborne reconnaissance.

The present invention obtains additional array aperture and resolution without adding (or requiring fewer) actual sensors. Virtual antennas may improve the resolution of existing arrays, and lower the system cost of new systems by requiring installation of fewer antennas. Unlike counter type devices, such as computed axial tomography (CAT) systems), the present invention provides both phase and amplitude.

Virtual antennas may be employed for applications using an integration approach to resolving raw data, such as auto-correlations and cross-correlations. In such application the correlation noise and cross-signal terms either tend to zero or are constant. In non-integrated, sample-by-sample applications, such as real time signaling, correlation noise and cross-signaling should be addressed. This is possible since the non-exponential distinguishing factor terms $n_1(t)$, $n_2(t)$ and $n_3(t)$ are not, in fact, independent.

Figure 1F:
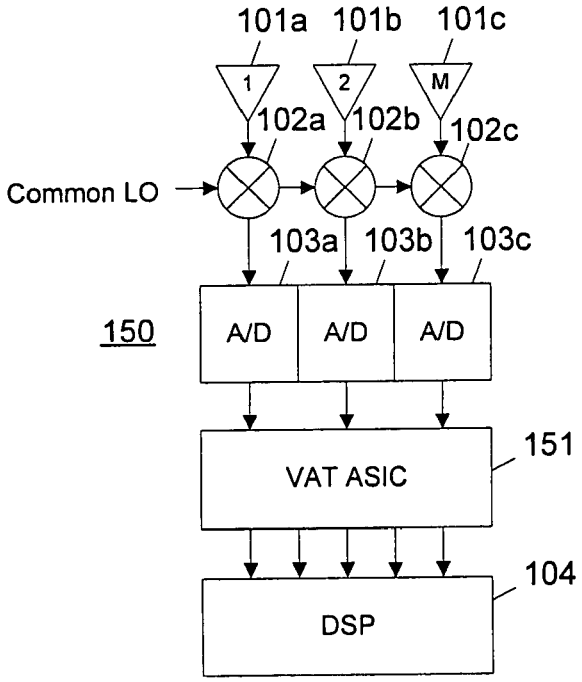

FIG. 1F illustrates an antenna array system employing virtual antennas according to one embodiment of the present invention. Antenna system 150 may be implemented by insertion of a virtual antenna technology application specific integrated circuit (ASIC) 151 performing the computations described above between the A/D converters 103*a*–103*c* and the digital signal processor 104 of a traditional antenna array system.

FIGS. 2A through 2I illustrate an annular ring antenna structure according to one embodiment of the present invention. The annular ring antenna structure of this embodiment may be used in conjunction with the virtual antenna technology described above, or independently.

Figure 2A:
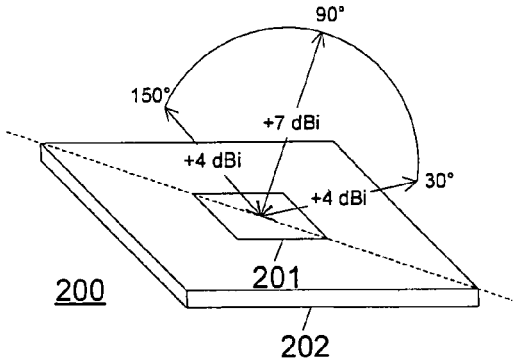
FIGS. 2A through 2I illustrate an annular ring antenna structure according to one embodiment of the present invention.

FIG. 2A depicts a patch antenna 200. Patch antennas typically include a copper patch 201 of approximately ½ inch by ½ inch on a printed circuit board (PCB) material 202, such as FR4 or G10. The antenna 200 exhibits a half-hemisphere radiation pattern with 4 decibel gain with reference to an isotropic radiator (dBi) at 30° and 7 dBi at 90°. Antenna 200 is flat or conformal and provides near half-hemisphere coverage, with roughly +4 to +7 dBi boresight gain. This structure is suitable for frequencies under 5 gigaHertz (GHz), but exhibits unacceptable losses for frequencies greater than 5 GHz, requiring use of low noise amplifiers to overcome losses.

Figure 2B:
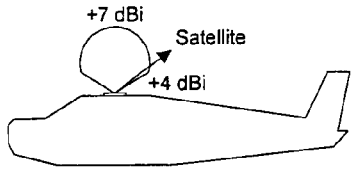

The simple patch antenna structure 200, when mounted on the top of a wing or the fuselage for an aircraft as shown in FIG. 2B, provides about +4 to +7 dBi gain in directions at which a satellite signal may be received during flight, which is too low to support high speed data and/or satellite (television) video. Thus, while providing full half-hemisphere coverage in a simple, inexpensive manner, the simple patch antenna is unsuitable for transmission in the Ku-band.

Figure 2C:
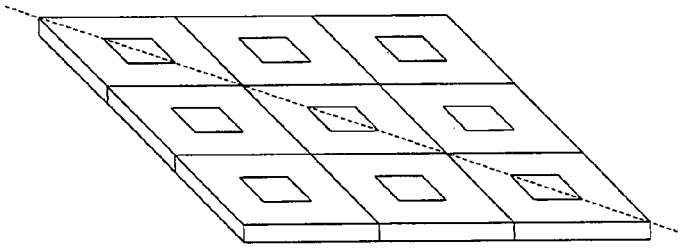

FIG. 2C illustrates a patch antenna array, in which a plurality of patch antennas are arranged in rows and columns. The increase in effective area produces an increase in antenna gain, making the patch antenna array a cost effective method to improve antenna area and gain. The signals from the individual antenna elements within the array are summed in phase. For a nine element patch antenna array as illustrated, this increases maximum gain by 10 log(9)−9.5 dBi, achieving a boresight gain of 7 dBi+9.5 dBi=16.5 dBi and a gain at thirty degrees of 4 dBi+9.5 dBi=13.5 dBi.

Figure 2D:
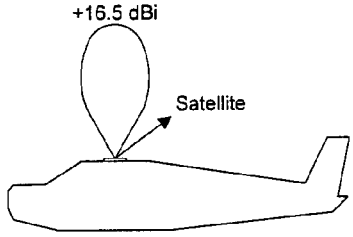

However, summing the signals in phase produces a single, narrow, fixed beam projected straight up from the array, which is unlikely to be the direction of a satellite relative to an aircraft, as shown in FIG. 2D. Thus, while the patch antenna array is simple and inexpensive and produces higher gain, the gain is not steered to satellites, and is still too low to support high speed data and/or satellite video. Gain on the order of +30 to +34 dBi is required to support high speed data and satellite television for higher end aircraft.

Beam steering required for high gain may be achieved by mechanical means, RF phasing of the array, or digital phasing of the array (digital beamforming). The mechanical approach, while inexpensive, suffers from poor reliability and requires a significant radome size, causing significant aerodynamic drag for small aircraft and highly increasing structural loading and Federal Aviation Administration (FAA) certification costs. Use of an RF phased array produces a flat profile with low drag, but is extremely expensive due to the high cost of phase shifters.

Use of a digital phase array (digital beamforming) to steer a patch antenna array produces a flat profile with low drag, uses low cost DBS RF components and DSP components having costs that are quickly and steadily becoming considerably lower, and provides a large range of added features.

Using a 3×3 annular ring patch antenna array illustrated in FIG. 2C with a total array size of approximately 3 inches by 3 inches, a gain of about +13.5 dBi on a fixed beam within the 30° to 50° elevation range necessary for DirecTV and EchoStar from a purely passive design. However, that gain is insufficient for television or data, since satellite dishes produce +34 dBi gain. The need for additional gain requires steering, but the annular ring structure reduces DBF complexity and costs.

Figure 2E:
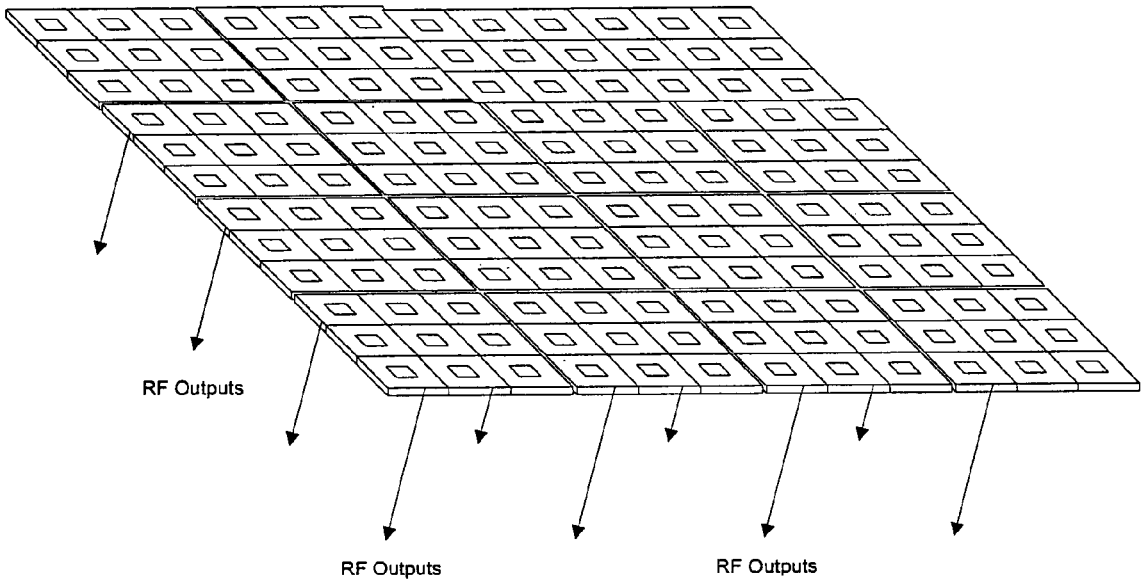
Figure 2F:
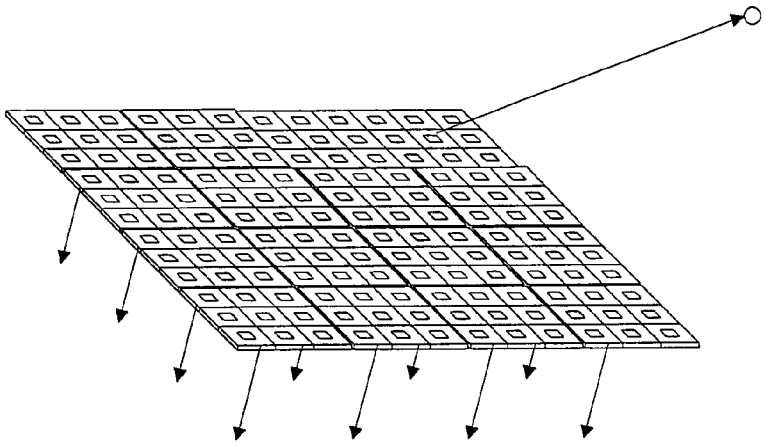
Figure 2G:
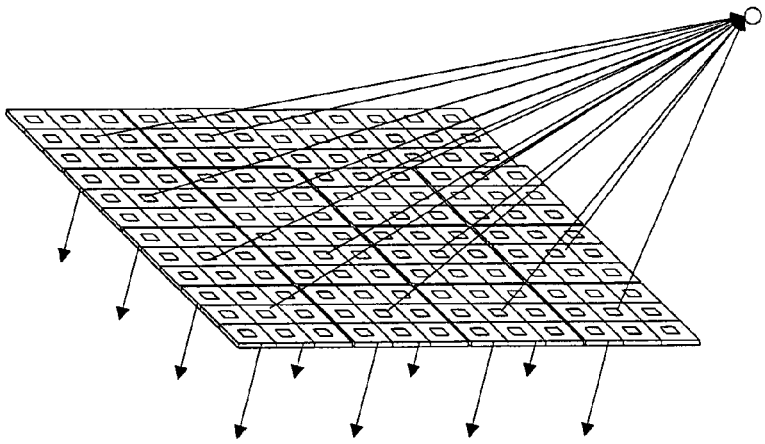

FIG. 2E depicts an annular ring patch antenna array according to one embodiment of the present invention. Four rows and four columns of 3×3 sub-arrays, having a total size of approximately 12 inches by 12 inches, are combined appropriately to achieve a passive gain improvement of 10 log(16)=12 dBi. Steering of the 16 beams is still required. In the present invention, each antenna sub-array element generates its own annular ring radiation pattern with 13.5 dBi gain, so that there are 16 annular rings (patterns), and is connected to a separate RF output as shown in FIG. 2E. Using beamforming, the beam within an annular ring may be "phased" to point to a particular location in space, as illustrated in FIG. 2F. Each individual antenna patch sub-array is beamformed summed to the same point in space as shown in FIG. 2G, producing constructive interference.

Use of an annular ring passive antenna structure steered to particular satellites in the sky, assumed to be located between particular elevation angles from a horizontally positioned flat panel when the antenna array is located anywhere across a geographic region of coverage (e.g., the continental United States), combined with a multi-element digital beamformer reduces the number of DBF elements required by a factor of 9 to 16 times, with a corresponding reduction in cost.

Assuming that a 3×3 sub-array generates approximately 13.5 to 15 dBi gain towards the satellite between a 30° and 50° elevation angle, beamform summing the sub-arrays to the same point simply adds their power together, so that 16 sub-arrays produce a gain of 10 log(16)=12 dBi with an effective total antenna gain of 13.5 dBi+12 dBi=25.5 dBi or 15 dBi+12 dBi=27 dBi.

An additional 2–3 dBi of gain should be possible using low noise amplifiers (LNAs) at the RF feed points to a downconverter, significantly improving aperture efficiency so that a 9 inch by 9 inch 16×16 array should generate, between 30° and 50° elevation, roughly 26 to 30 dBi at broadside and roughly 25 to 28 dBi at 30 degrees elevation. Since satellite dishes have +34 dBi gain, and additional 9 to 6 dB is needed. By increasing the overall array size of the 16×16 array to 18 inches by 18 inches, with LNAs directly at the feed points, +34 dBi gain should be generated.

Figure 2H:
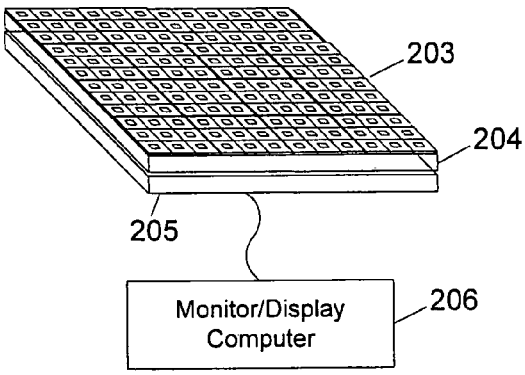
Figure 2I:
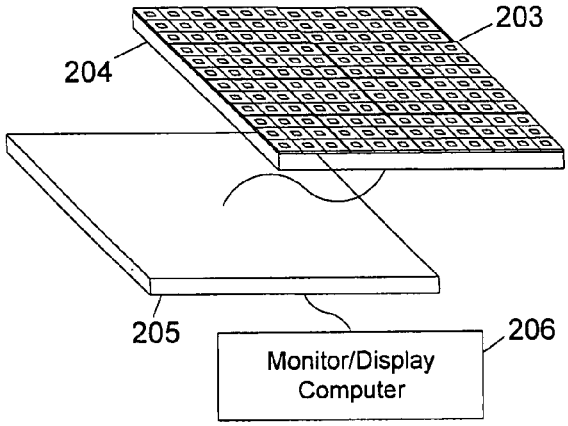

FIGS. 2H and 2I illustrate different configurations of a beamformed steered patch antenna array system according to the present invention. Each includes an antenna array 203 of the type described above coupled to a downconverter block 204 (including LNAs at the feed points). The downconverter 204 is connected to a digital signal processor block 205 either directly as illustrated in FIG. 2H or by cables as illustrated in FIG. 2I. The digital signal processor block 205 is connected by cables to a monitor or display computer 206.

Many different passive antenna types and configurations will produce an annular ring radiation pattern, such as a combination of horizontal patch elements or a combination of vertical dipoles. Conventional digital beamforming methodologies apply or require a transmit/receive module or blocks for each patch element to allow beamforming (generation) of a beam in any direction within the half-hemisphere. Thus, for example, the system of FIG. 3E would require 3×3×4×4=144 transmit/receive modules, or more. However, for most satellite applications, the direction (beam) to the satellite is between a fixed range in the elevation plane, so that sub-element arrays can be used to generate the beams (M element sub-array), reducing the number of effective array elements by M and correspondingly reducing the number of required digital beamforming transmit/receive modules by M.

The present invention uses known and fixed geo-satellite positions and an annular ring antenna structure to reduce the complexity, number of components, and cost of a digital beamformer for moving platforms.

Figure 3A:
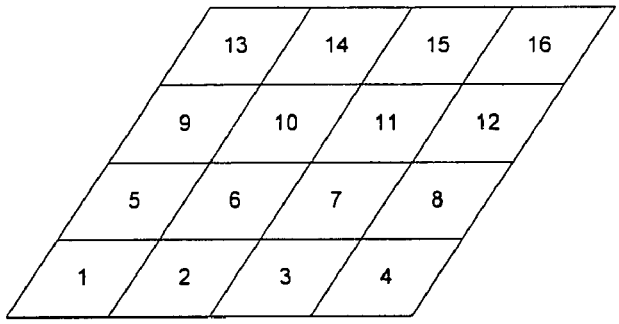
FIGS. 3A through 3C illustrate the structure and operation of an antenna array with perturbation of sub-patch element phases to compensate for pitch and roll according to one embodiment of the present invention.
Figure 3B:
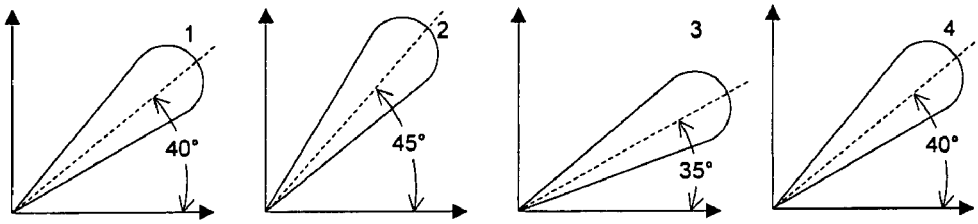
Figure 3C:
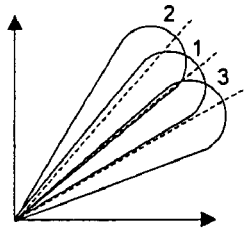

FIGS. 3A through 3C illustrate the structure and operation of an antenna array with perturbation of sub-patch element phases to compensate for pitch and roll according to one embodiment of the present invention. Perturbation of sub-patch elements as described in connection with these figures is an optional modification of the invention depicted and described above in connection with FIGS. 2E through 2I, and may optionally be utilized in conjunction with the virtual antenna technology described above, or independently.

FIG. 3A illustrates an antenna array with a plurality of sub-patch arrays 1–16 arranged in rows and columns. Each individual sub-patch array 1–16 has an annular ring and is perturbed in elevation angle to have a different elevation angle center, such as 40°, 45°, 35° and 40° for sub-patch arrays 1–4 as illustrated in FIG. 3B. A digital beamformer then sums the signals from the antennas to the optimal elevation angle, to increase the elevation angle range from, for example, 30°–50° to 15°–60°. In this manner, significant increase in allowable platform pitch and roll may be achieved with extremely high speed adaptation of the array.

Figure 4A:
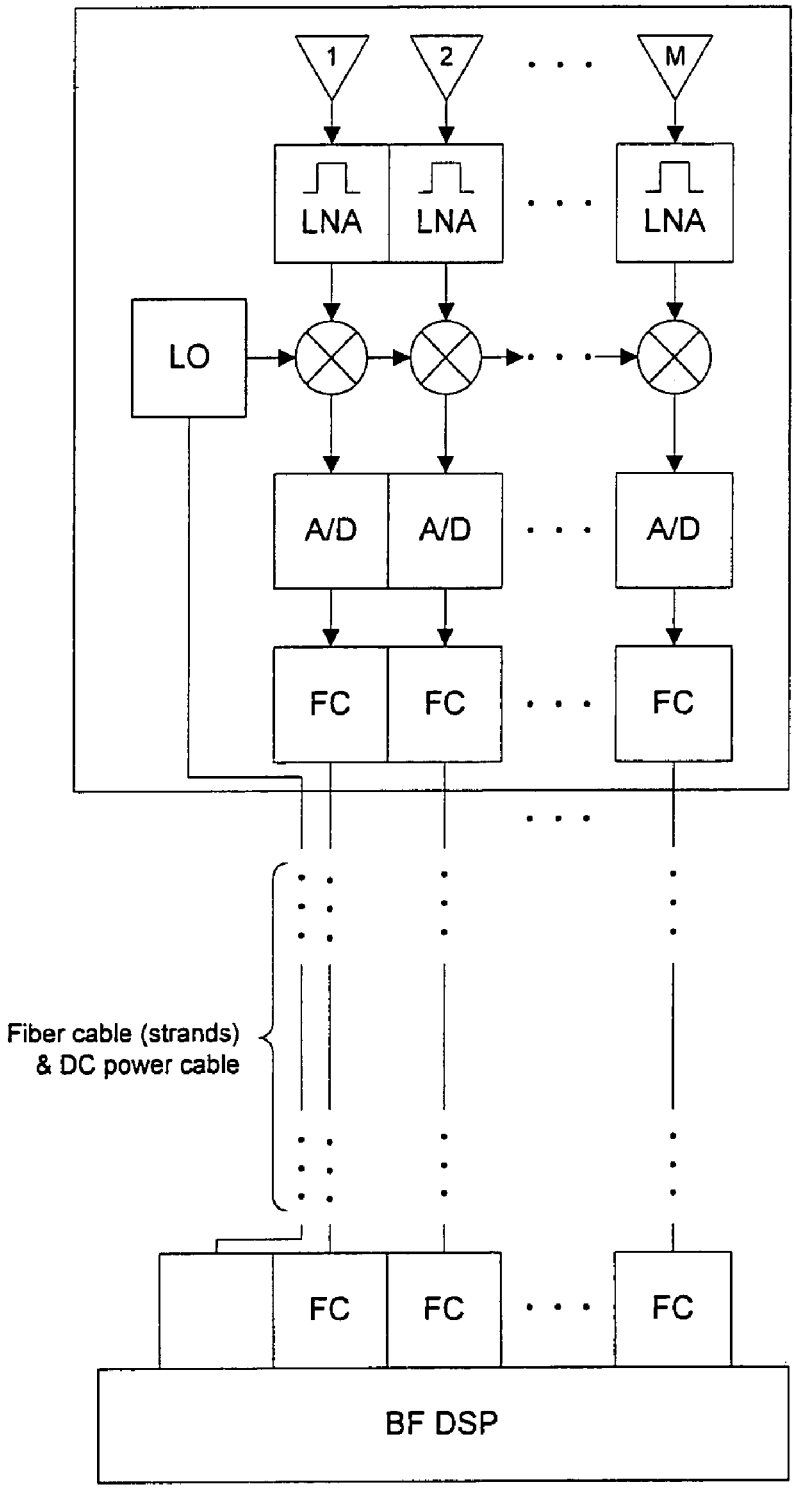
FIGS. 4A and 4B depict modular, fiber transport antenna array system architectures for a beamformer according to one embodiment of the present invention.
Figure 4B:
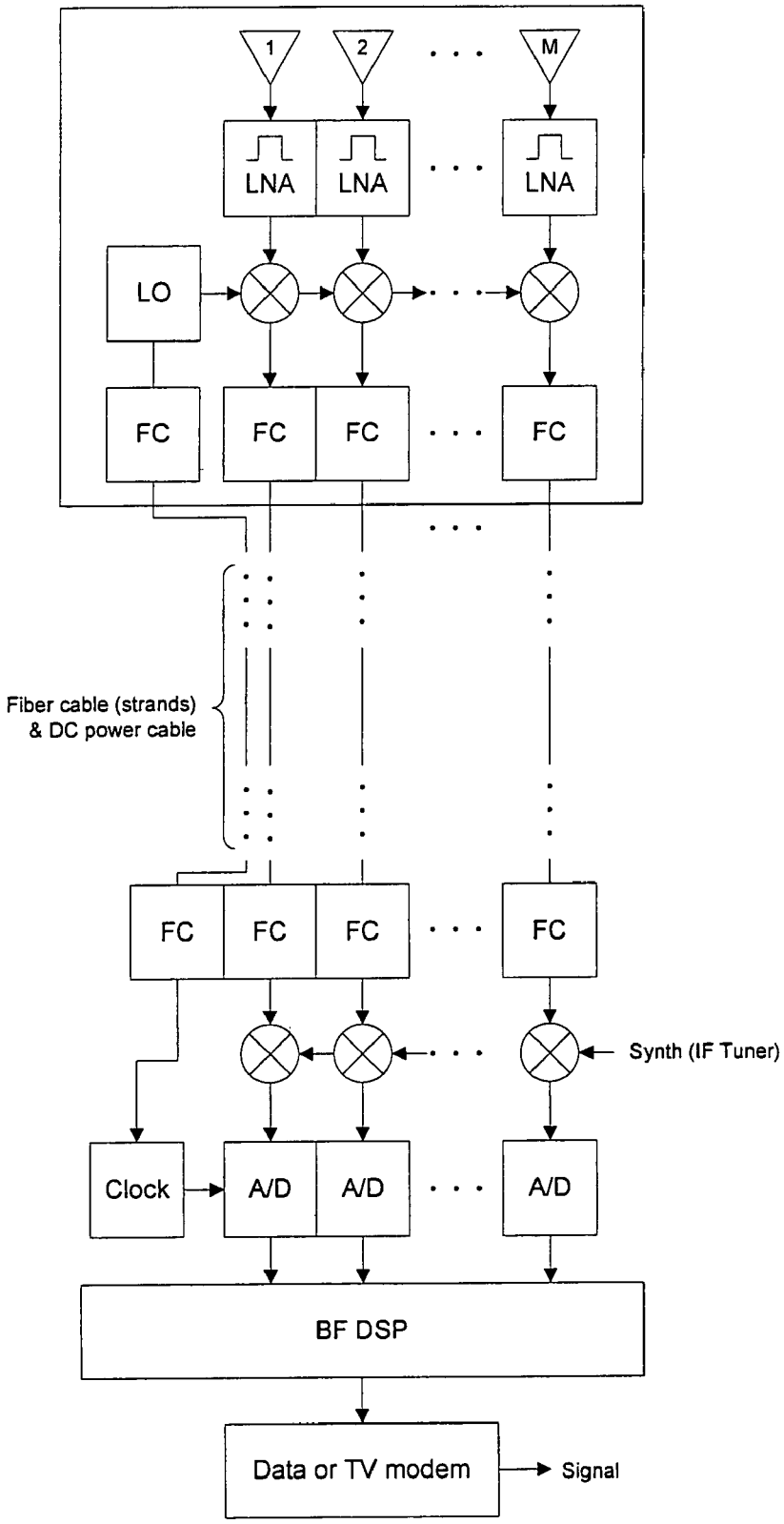

FIGS. 4A and 4B depict modular, fiber transport antenna array system architectures for a beamformer according to one embodiment of the present invention. The architectures depicted and described may be employed in conjunction with any or all of the virtual array technology, the annular ring antenna technology, and/or the perturbation of sub-patch element phases to compensate for pitch and roll as described above, or independently.

In the embodiment illustrated in FIG. 4A, antenna elements, filters/LNAs, block converters (to the intermediate frequency) and fiber converters are implemented in one module. That module is coupled by a fiber cable and DC power cable to a separate module within the platform also including fiber converters together with a DSP. Keeping the antenna array size small requires high antenna efficiency and low transmission line losses out of each sub-element to the sub-branched point (trunk). In the present invention, this need is addressed by including an LNA directly at the element feed to overcome the subsequent transmission line losses. However, it may NOT be desirable to have the DSP at the antenna, in order to provide flexibility in the features to be added or changed, which would be difficult if the DSP were located at the antenna (platform exterior) location. Transporting microwave signals on a cable is undesirable due to high losses and the expense. On the other hand, tuning with the DSP and IF conversion with A/Ds are both desirable. Thus, use of fiber cables, which are easy to route, when the DSP is not at the antenna location requires analog transport over fiber rather than digital signals. The A/Ds may thus be moved to the other end of the fiber cable as shown in FIG. 4B.

Although the present invention has been described in detail, those skilled in the art will understand that various changes, substitutions, variations, enhancements, nuances, gradations, lesser forms, alterations, revisions, improvements and knock-offs of the invention disclosed herein may be made without departing from the spirit and scope of the invention in its broadest form.

What is claimed is:

1. An antenna array system comprising:

a plurality of spaced antenna elements; and a controller coupled to the antenna elements, the controller determining a magnitude and phase relationship between a first signal sample taken at a first antenna element at a first time and a second signal sample taken at a second antenna element at a second time, the controller employing the magnitude and phase relationship to compute a projected signal sample for a virtual antenna element based on a third signal sample taken at the first antenna element at the second time.

2. The antenna array system according to claim 1, wherein the projected signal sample is employed as a signal sample taken at the virtual antenna element at the first time.

3. The antenna array system according to claim 1, wherein the plurality of antenna elements are linearly aligned, the antenna array system further comprising:

a plurality of mixers each mixing a signal received at one of the antenna elements with a local oscillator frequency signal;

a plurality of analog-to-digital converters each receiving a mixed output from one of the mixers and converting the mixed output to a digital signal, wherein the controller receive the digital signals and computes the projected signal sample based on the digital signals; and a digital signal processor receiving the digital signals from each of the analog-to-digital converters together with the projected signal sample from the controller.

4. The antenna array system according to claim 1, wherein the antenna array system has a beamformed array gain and half power bandwidth proportional to a number of antenna elements greater than a number of the plurality of antenna elements.

5. The antenna array system according to claim 1, wherein the controller determines multiple magnitude and phase relationships between signal samples taken at different antenna elements at different times and computes a plurality of virtual signal samples.

6. The antenna array system according to claim 5, wherein the antenna array system has a beamformed array gain and half power bandwidth proportional to M+P·(M−1), where M is a number of the plurality of antenna elements and P is a number of the virtual signal samples.

7. The antenna array system according to claim 1, wherein a virtual sensor is achieved by blind mapping, without movement of antenna array elements.

8. A system including the antenna array system according to claim 1, the system further comprising:

a plurality of arrays of patch antennas arranged in rows and columns, one of the plurality of arrays including the spaced antenna elements, wherein signals from each patch antenna within a given array are summed in phase, wherein the controller further comprises a multi-element digital beamformer phasing signals from each of the plurality of arrays to a single point.

9. The system according to claim 8, wherein each of the arrays is perturbed in elevation angle with respect to the remaining arrays.

10. The system according to claim 8, further comprising:

low noise amplifiers connected to feed points for each of the plurality of arrays; and a downconverter operating on outputs of the low noise amplifiers.

11. The system according to claim 10, wherein the antenna elements, low noise elements, and downconverter are implemented within one module coupled by a fiber cable to a digital signal processor.

12. A method of controlling an antenna array system comprising:

determining a magnitude and phase relationship between a first signal sample taken at a first antenna element within a plurality of spaced antenna elements at a first time and a second signal sample taken at a second antenna element within the plurality of spaced antenna elements at a second time;

employing the magnitude and phase relationship to compute a projected signal sample for a virtual antenna element based on a third signal sample taken at the first antenna element at the second time.

13. The method according to claim 12, further comprising:

employing the projected signal sample as a signal sample taken at the virtual antenna element at the first time.

14. The method according to claim 12, wherein the plurality of antenna elements are linearly aligned, the method further comprising:

mixing each signal received at one of the antenna elements with a local oscillator frequency signal;

receiving mixed outputs from the mixing and converting each of the mixed outputs from an analog signal to a digital signal, wherein the projected signal sample is computed based on the digital signals; and digitally processing the digital signals together with the projected signal sample.

15. The method according to claim 12, wherein the antenna array system has a beamformed array gain and half power bandwidth proportional to a number of antenna elements greater than a number of the plurality of antenna elements.

16. The method according to claim 12, further comprising:

determining multiple magnitude and phase relationships between signal samples taken at different antenna elements at different times; and computing a plurality of virtual signal samples.

17. The method according to claim 16, wherein the antenna array system has a beamformed array gain and half power bandwidth proportional to M+P·(M−1), where M is a number of the plurality of antenna elements and P is a number of the virtual signal samples.

18. The method according to claim 12, wherein a virtual sensor is achieved by blind mapping, without movement of antenna array elements.

19. An antenna system comprising:

a plurality of M spaced antenna elements each received signal;

a plurality of M mixers, each mixer mixing a received signal from one of the antenna elements with a local oscillator frequency;

a plurality of M analog-to-digital converters, each analong-to-digital converter converting an output of one of the mixers to a digital signal;

a virtual antenna controller receiving the digital signals, the virtual antenna controller sampling all of the digital signals at each of a plurality of times, determining a magnitude and phase relationship between a first of the digital signals corresponding to the received signal at a first of the M antenna elements at a first time $t_1$ and a second of the digital signals corresponding to the received signal at a second of the M antenna elements at a second time $t_2$, and employing the magnitude and phase relationship to compute a projected digital signal for a virtual antenna element based on a third of the digital signals corresponding to the received signal at the first antenna element at the second time $t_2$; and a digital signal processor operating on, collectively, the second and third digital signals and the projected digital signal.

20. The antenna system according to claim 19, wherein the antenna system operates with an array gain and half power bandwidth proportional to an array of M+1 antenna elements.

21. A controller for use with a plurality of spaced antenna elements comprising:

a controller that, when operable and coupled to the antenna elements, receives at least a first signal sample taken at a first antenna element at a first time, a second signal sample taken at a second antenna element at a second time, and a third signal sample taken at the first antenna element at the second time, determines a magnitude and phase relationship between the first signal sample and the second signal sample, and employs the magnitude and phase relationship to compute a projected signal sample for a virtual antenna element based on the third signal sample.

22. The controller according to claim 21, wherein the projected signal sample is employed as a signal sample taken at the virtual antenna element at the first time.

23. The controller according to claim 21, wherein the controller determines multiple magnitude and phase relationships between signal samples taken at different antenna elements at different times and computes a plurality of virtual signal samples.

24. A system including the controller according to claim 21, the system further comprising:

a plurality of arrays of patch antennas arranged in rows and columns, one of the plurality of arrays including the spaced antenna elements, wherein signals from each patch antenna within a given array are summed in phase, wherein the controller further comprises a multi-element digital beamformer phasing signals from each of the plurality of arrays to a single point.

* * * * *